US008556499B2

(12) United States Patent
Queval

(10) Patent No.: US 8,556,499 B2
(45) Date of Patent: Oct. 15, 2013

(54) ANTI-TRIP DEVICE FOR AN ESCAPE MECHANISM

(75) Inventor: Arthur Queval, Neuchatel (CH)

(73) Assignee: Nivarox-FAR S.A., Le Locle (CH)

( * ) Notice: Subject to any disclaimer, the term of this patent is extended or adjusted under 35 U.S.C. 154(b) by 159 days.

(21) Appl. No.: 13/287,558

(22) Filed: Nov. 2, 2011

(65) Prior Publication Data

US 2012/0113765 A1 May 10, 2012

(30) Foreign Application Priority Data

Nov. 4, 2010 (EP) ..... 10190000

(51) Int. Cl.
*G04B 15/00* (2006.01)
*G04B 17/20* (2006.01)

(52) U.S. Cl.
USPC ..... 368/127; 368/131; 368/171

(58) Field of Classification Search
USPC ..... 368/127, 130–132, 169–171
See application file for complete search history.

(56) References Cited

U.S. PATENT DOCUMENTS

| | | | | |
|---|---|---|---|---|
| 180,290 | A | 7/1876 | Voigt | |
| 361,850 | A * | 4/1887 | Van Strait | 368/176 |
| 710,823 | A * | 10/1902 | Voigr | 368/132 |
| 867,015 | A * | 9/1907 | Coullery | 368/127 |
| 2006/0233052 | A1* | 10/2006 | Zaugg et al. | 368/76 |
| 2007/0140066 | A1 | 6/2007 | Lechot et al. | |
| 2010/0238769 | A1* | 9/2010 | Zaugg et al. | 368/127 |

FOREIGN PATENT DOCUMENTS

| | | | |
|---|---|---|---|
| CH | 700 091 | A1 | 7/2010 |
| EP | 1 522 001 | B1 | 4/2005 |
| EP | 1 645 918 | A1 | 4/2006 |
| EP | 1 666 990 | A2 | 6/2006 |
| EP | 1 708 046 | A1 | 10/2006 |
| EP | 1 708 047 | A1 | 10/2006 |
| EP | 1 770 452 | A1 | 4/2007 |
| EP | 1 801 668 | A1 | 6/2007 |
| EP | 1 860 511 | A1 | 11/2007 |
| EP | 2 224 292 | A2 | 9/2010 |

OTHER PUBLICATIONS

European Search Report for corresponding EP 10 19 0000.9, dated May 3, 2011.

* cited by examiner

*Primary Examiner* — Vit W Miska
(74) *Attorney, Agent, or Firm* — Sughrue Mion, PLLC

(57) ABSTRACT

Anti-trip device (1) for a balance (2) pivoting about an axis (D1) whose position is fixed relative to a plate (3).
It includes a banking pin (5) on said plate (3), a bistable assembly (8) including:

a rotor (9) which is synchronous with said balance (2) and a lever (11) pivoting about another axis (D2) of said rotor (9) between two extreme positions of indexing means (12) memorizing the position of said balance (2), the trajectory of said lever (11) partially interfering with said banking pin (5) when said balance (2) is pivoting;

means (15) for limiting amplitude in the event of a shock, which includes stop means (16) between said lever (11) and said banking pin (5), forming a pivot stop during a normal arc of the balance and which, when pressed, generates a change of position in said indexing means (12) and a stop for said balance (2) in the event of knocking.

20 Claims, 4 Drawing Sheets

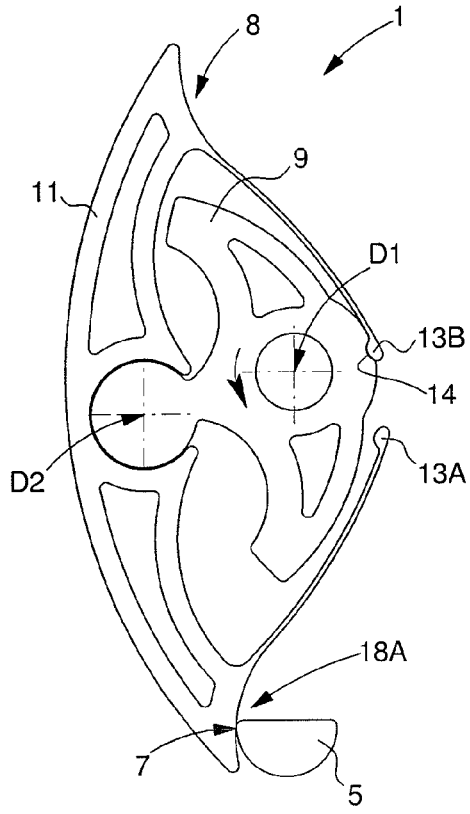
Fig. 6
Fig. 7
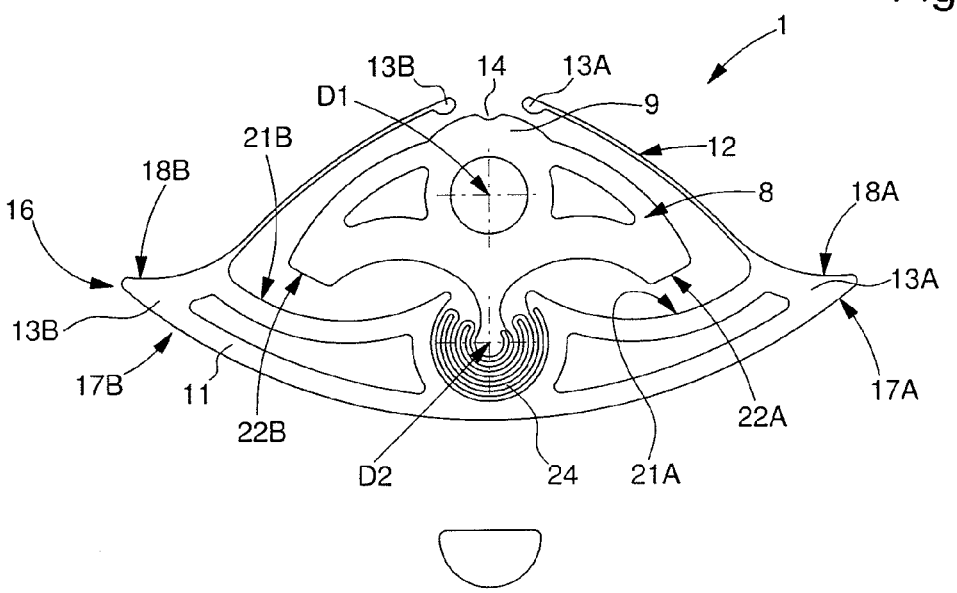

ANTI-TRIP DEVICE FOR AN ESCAPE MECHANISM

This application claims priority from European Patent Application No. 10190000.9 filed Nov. 4, 2010, the entire disclosure of which is incorporated herein by reference.

FIELD OF THE INVENTION

The invention concerns an anti-trip device for an escape mechanism, arranged to cooperate with a balance which pivots about a first pivot axis whose position is fixed relative to a plate.

The invention also concerns an escape mechanism including at least one balance, which is pivotally moveable relative to a plate and pivots about a balance axis.

The invention also concerns a timepiece movement including at least one such escape mechanism.

The invention also concerns a timepiece including at least one timepiece movement of this type and/or at least one escape mechanism of this type.

The invention concerns the field of horology, in particular the field of escape mechanisms, and more specifically the field of detent escapements.

BACKGROUND OF THE INVENTION

Detent escape mechanisms are reputed to be the most precise, and have long been reserved for marine chronometers.

The efficiency of detent escape mechanisms is greater than that of lever escapements, because the escape wheel only communicates an impulse to the balance once per oscillation, during which the escape wheel pivots through one angular step. Consequently, the loss of energy due to the inertia of the escape wheel occurs once per oscillation, as opposed to once per vibration in lever escapements.

The use of detent escapements in wristwatches is more complex, because of the sensitivity of such escapements to shocks.

In the event of shocks, particularly lateral shocks, if the balance is made to pivot outside its normal amplitude, one tooth of the escape wheel may leave the locking stone, and unlocking and impulses occur twice in the same vibration. The effect of this phenomenon, called "tripping", is to distort the isochronism of the oscillator.

EP Patent No. 1 708,047 in the name of MONTRES BREGUET S A discloses a lever, which includes an arm carrying both a first finger for cooperating with the second actuating finger, and a feeler with a beak cooperating with a notched cam similar to the preceding ones. When the balance and the plates thereof pivot in a first direction, the first finger drives the second finger to release the locking pallet stone(s) from the escape wheel. The feeler arm beak is then driven by a rising flank of the cam notch to re-engage the locking means in the escape wheel. When the balance pivots in the opposite direction, the first finger drives the second finger to keep the locking means engaged in the escape wheel. When the first and second fingers meet, in whatever direction the rollers are pivoting, a natural rotating force is generated on the lever arbour. This encounter does not generate any risk of breaking the mechanism. No resilient member or stop pins are necessary. In a particular embodiment, this mechanism includes two juxtaposed locking stones including contiguous but non-aligned locking faces, which enables the tip of the escape wheel tooth to be housed on a locking line at the junction of the locking faces, creating a draw effect which dispenses with the need for any stop pin. The locking face of the locking stone closest to the escape wheel rises up before the tooth and prevents it from continuing on its way. In this total lock position of the escape wheel tooth, the beak of the feeler arm moves away from the periphery of the roller leaving the balance completely free to complete the first vibration. This design makes the escapement resistant to shocks. Indeed, a shock returns the beak onto the periphery of the corresponding roller, without however unlocking the locking stones, since the return of the tooth onto the locking line occurs immediately owing to the draw effect. When, afterwards, during the return movement of the balance in the opposite direction, towards the end of the second vibration, the first finger and the second finger come into cooperation, they give rise to torque in the detent lever around its pivot axis, causing a slight recoil of the escape wheel tooth, before, when the fingers separate, the tooth returns to the locking line in an anti-draw effect.

EP Patent No. 1 708,046 in the name of MONTRES BREGUET S A discloses a safety finger secured to the balance roller, and arranged to cooperate with the escape wheel teeth and lock the wheel if the impulse pallet stone should be accidentally released from the toothing of the wheel. This arrangement prevents any disconnection of the escape wheel, in the event of a shock, resulting in a reversal of the direction of rotation of the plates at the precise moment of the wheel impulse. The collision of one tooth of the wheel with this security finger locks the wheel and returns the plates to the proper direction of rotation.

EP Patent No 1 522 001 in the name of Detra S A and Patek Philippe S A proposes an escape mechanism with locking parts and toothed wheels with gaps in the toothing. The first wheel set is subjected to a periodic torque, obtained for example by a rotor mounted in a stator. This first wheel set includes, on the one hand, in a basic plane, a first wheel with gaps in the toothing over the periphery thereof, and on the other hand, in a second plane, a first brake-lever including several teeth able to lock a release lever comprised in a balance roller, when the balance pivots in a first direction. Depending upon its position, this first wheel set cooperates with a second wheel set, either via the first brake-lever or via the first wheel thereof. This second wheel set includes, in the basic plane, a second wheel with toothing gaps, and in the second plane, a shaped part which includes several fingers and can lock the balance roller release lever in a second direction of pivoting opposite to the first. The second wheel set further includes a locking part in a first plane parallel to the preceding planes. Depending upon its position, this second wheel set cooperates, either via the locking part, or via the second wheel thereof, with an escape wheel, which includes, in the basic plane, a toothed wheel with toothing gaps, and in the first plane, an impulse wheel, which receives a continuous mechanical torque such as that from a barrel, similar to a conventional escape wheel, and can cooperate with the impulse lever comprised in the balance roller, to maintain the oscillating movement of the balance. Depending upon the respective angular positions of the various wheel sets, the locking parts, or shaped parts, or teeth, cooperate with each other, such that the device has four stable locking positions for each revolution of the first pin, between which it has the same number of unlocking positions. The combination of two locking means and two unlocking means for the mechanical torque, and the particular sequence imposing an unlocking operation between two locking operations prevent any racing or tripping in the event of a shock to the mechanism. This mechanism is complex, relatively expensive and extends over several planes, which gives it significant thickness.

EP Patent No. 1 770 452 in the name of Baumberger Peter is an improvement of the Voigt U.S. Pat. No. 180,290 devised to minimise the requirement for space, and it discloses a conventional detent escapement with a detent lever that pivots and is returned by a spiral spring. One arm of the lever carries one end of a strip spring, the other end of which is held abutting on a stop member carried by another arm of the lever, and is arranged to cooperate with a locking pallet-stone integral with a small balance roller. Another arm of the lever, beyond a locking stone, includes a finger which cooperates with the periphery of this small roller, and in particular with a truncated portion forming a cam, at a lower level than that of the strip spring. A large balance roller conventionally carries an impulse pallet, preceded by a first recess, and followed by a second recess, to allow the locking stone to be unlocked when the unlocking stone pivots the detent lever. The selection of a particular geometry, both as regards the position of the locking stone and the impulse pallet in quasi-symmetry with the line at the centres of the escape wheel and the balance during the locking phase, and the fork formed by the finger and the free end of the strip spring, limit the disruptive effect linked to the detent inertia on the balance oscillations. The amplitude of the pivoting movements of the detent, in the event of shock, is limited by the interaction of the locking stone and the large roller. In a complementary embodiment, this mechanism includes an anti-trip mechanism, in proximity to the small roller, pivotably mounted on the movement between two stable end positions maintained by a jumper spring on stop members with which a first end can cooperate and the second fork-shaped end of which interacts with the discharging pallet: each time the discharging pallet passes into the fork it exerts pressure to tip the anti-trip lever from one stable position to the other. The fork thus forms two stops for the small roller in the event of any tripping, and prevents the balance from pivoting through more than one revolution.

EP Patent No. 1 860 511 in the name of Christophe Claret S A discloses a movement with a moveable bridge, providing protection for a detent escapement against lateral shocks. This moveable bridge carries the sprung-balance pivot axis, the escape wheel pivot axis, the detent pivot axis and part of the gear train. It is pivoted elastically on the arbour of one of the gear train wheels, for example the seconds wheel. Forces, such as a lateral shock, capable of unlocking the locking stone, then drive the entire moveable bridge and the relative positions of the detent and the escape wheel are maintained. This ensures constant operation of the escapement. The moveable bridge may also be dampened by a dampening system which dissipates part of the energy due to the shock.

CH Patent Application No 700 091 in the name of Christophe Claret S A discloses a detent escapement, with a detent lever pivotably mounted on a spiral spring cooperating at the other end with a first strip spring embedded in proximity to the pivot. The balance roller includes two distinct discharging pallets. A wheel set arranged on the opposite side of the escape wheel relative to the detent lever, carries a pivoting cam, holding a cam strip spring and returned towards the detent by a spiral spring onto a stop position. This cam is arranged for making the cam strip spring cooperate, either in a first state, with the end of the lever carrying the strip spring, or in a second state, with the discharging pallets of the balance. The first discharging pallet is arranged to cooperate with the first strip spring and actuate the detent when the first pallet encounters the first strip in a first direction, and to cooperate only with the first strip, without actuating the detent, when it encounters the first strip in the opposite direction. When the cam is in the first state it cooperates with the detent to limit the movements thereof. The second discharging pallet is arranged for changing the cam to the second state in which the detent is free to perform its unlocking operation and release the escape wheel tooth from the locking stone. The two unlocking pallet stones are close and arranged such that the cam is brought into its second state just before the detent performs the unlocking operation. The spiral cam return spring, which is stronger than the cam strip spring, tends to return the cam to its first state. Thus, in the first state thereof, the cam is positioned so as to oppose any inadvertent movement of the detent which could result in inadvertent unlocking of the locking stone, and the escapement is less sensitive to the effects of a shock. Adjustment of this mechanism is complex, since it depends upon the features peculiar to the springs comprised therein, of which there are at least three.

EP Patent No. 2 224 292 in the name of Rolex S A discloses a direct impulse escapement, particularly a detent escapement. The detent lever is arranged in a particular manner, pivoting between two stop members. Facing the escape wheel, it includes a finger including, in succession, a stop surface used as the locking stone, a safety surface which, depending upon the pivotal position of the lever, either interferes or does not interfere with the escape wheel trajectory, and a sliding surface which forces the lever to tip, when the escape wheel is pivoting, so as to return the sliding surface and thus the stop surface to the area of interference with the escape wheel, to stop said wheel pivoting. The balance roller conventionally includes an impulse pallet and an unlocking finger. During the vibration in a first pivoting direction of the balance, the lever is in a first stopped pivotal position which allows the unlocking finger to pass, whereas in the other vibration in the other pivoting direction, the lever is pivoted into another stop position and encounters the unlocking finger at an elastic unlocking element comprised in said lever. The elastic travel of this elastic unlocking element allows the balance to continue its travel and the impulse pallet passes between two adjacent teeth of the escape wheel. Shortly afterwards, the balance is stopped by the balance spring thereof and pivots in the opposite direction. During this elastic travel, the lever remains butting against the stop member and the stop surface of the lever slides over the escape wheel tooth which is kept stopped. The safety of this mechanism is ensured by the arrangement of the lever finger, with one stop surface and one sliding surface which alternately run into the trajectory of the escape wheel toothing. The length of the safety surface between the stop surface and the sliding surface corresponds to the angle travelled by the wheel to communicate the drive energy to the balance, to prevent the premature return of the stop element into the trajectory of the wheel, which provides additional security. Part of the energy from the barrel is, however, consumed in friction during the sliding phase.

Few Patent documents are specifically dedicated to anti-trip mechanisms.

EP Patent No. 1 645 918 in the name of MONTRES BREGUET S A discloses a mechanism of this type, including a finger secured to an arm of the balance. The balance cock includes two columns, between which this finger can pass. A locking arm is secured to the outer coil of the balance spring, particularly by clamping, and when the balance tends to race under the effect of a shock and exceed its normal amplitude, the arm can abut on the columns to prevent the finger from passing.

EP Patent No. 1 801 668 in the name of MONTRES BREGUET S A discloses an arrangement of a balance axis fitted with a pinion, which cooperates with a toothed sector that can move between two stop positions and prevents the balance from pivoting beyond its normal amplitude.

In short, known embodiments are often complex and difficult to adapt from one escape mechanism to another. The method of stopping the balance is generally very abrupt and does not always ensure that the movement will restart without intervention.

SUMMARY OF THE INVENTION

The invention proposes to overcome the shortcomings of the prior art, by proposing a mechanism which is simple, reliable, inexpensive and easy to adapt to existing escape mechanisms.

The invention therefore concerns an anti-trip device for an escape mechanism, arranged to cooperate with a balance, which pivots about a first pivot axis, whose position is fixed relative to a plate, characterized in that said device includes a banking pin arranged to be fixed to said plate, and at least one moveable bistable assembly, which includes, on the one hand, at least one rotor arranged to be fixed to said balance and to pivot synchronously therewith, and on the other hand, a moveable bistable lever that pivots relative to said rotor about a second pivot axis, parallel to said first pivot axis, over a limited angular sector between two indexing positions that can be occupied by indexing means, comprised in said bistable assembly for memorising the position of said balance, wherein at least one part of the trajectory of said bistable lever interferes with said banking pin when said balance pivots, and said bistable assembly further includes amplitude limiting means for limiting the amplitude of angular pivoting of said balance in the event of a shock.

According to a feature of the invention, said amplitude limiting means includes at least first stop means between said bistable lever and said banking pin, arranged to form, on the one hand a pivot stop, when the amplitude of pivoting of the balance is normal and which, when said bistable assembly presses thereon, generates a change of position in said indexing means, and on the other hand, a stop member for said balance if any knocking occurs in the event of a shock to said balance or to an assembly including said balance.

According to a feature of the invention, said first stop means includes at least a first shake stop surface which is comprised in said bistable lever and arranged to cooperate with a first frontal surface of said banking pin which points towards said first pivot axis, and said means further includes at least one second knocking stop surface, which is comprised in said bistable lever and arranged to cooperate with a second lateral surface of said locking pin, and which points in a substantially orthogonal direction to that which joins said pin to said first pivot axis.

According to a feature of the invention, said amplitude limiting means includes at least second stop means between said bistable lever and said rotor.

According to a feature of the invention, said second stop means includes at least a third stop surface which is comprised in said bistable lever and arranged to cooperate, in a stop position, with at least one rotor stop surface of said rotor.

According to a feature of the invention, on said bistable lever, said indexing means includes, for each said indexing position, a lever arm, or respectively a lever notch, arranged to cooperate respectively with a rotor notch or a rotor arm of said rotor.

According to a feature of the invention, said bistable lever includes at least a first lever arm and a second lever arm, which correspond to said indexing positions between which said bistable lever can pivot. Each arm is returned to said second pivot axis by elastic return means and is arranged to cooperate in turn with said rotor notch, arranged at the periphery of said rotor.

According to a feature of the invention, said bistable assembly is made in a single-piece and the connection between said rotor and said bistable lever is achieved by elastic return means.

According to a feature of the invention, said bistable assembly is made in a single-piece with a balance.

According to a feature of the invention, said bistable assembly is made in a single-piece with said balance, which is itself made in a single-piece with a balance spring.

According to a feature of the invention said rotor and/or said bistable lever is made of silicon, or quartz, or a compound thereof, or of an at least partially amorphous material.

The invention further concerns an escape mechanism including at least one balance, which is pivotally moveable relative to a plate and pivots about a balance axis, characterized in that the mechanism is a detent escape mechanism, and in that it includes an anti-trip device of this type, wherein said banking pin is fixed to said plate, said rotor is fixed to an arbour of said balance, and said bistable lever is pivotally mounted about a second pivot axis parallel to said first pivot axis.

The invention also concerns a timepiece movement including at least one such escape mechanism.

The invention also concerns a timepiece including at least one timepiece movement and/or at least one escape mechanism of this type.

DESCRIPTION OF THE DRAWINGS

Other features and advantages of the invention will appear more clearly upon reading the following detailed description, with reference to the annexed drawings, in which:

FIG. 6 shows a schematic front view of the anti-trip device of FIG. 1 in a knocking position in an anti-clockwise state;

FIG. 7 shows a schematic front view of a variant of an anti-trip device according to the invention, in an assembly position.

DETAILED DESCRIPTION OF PREFERRED EMBODIMENTS

Figure 1:
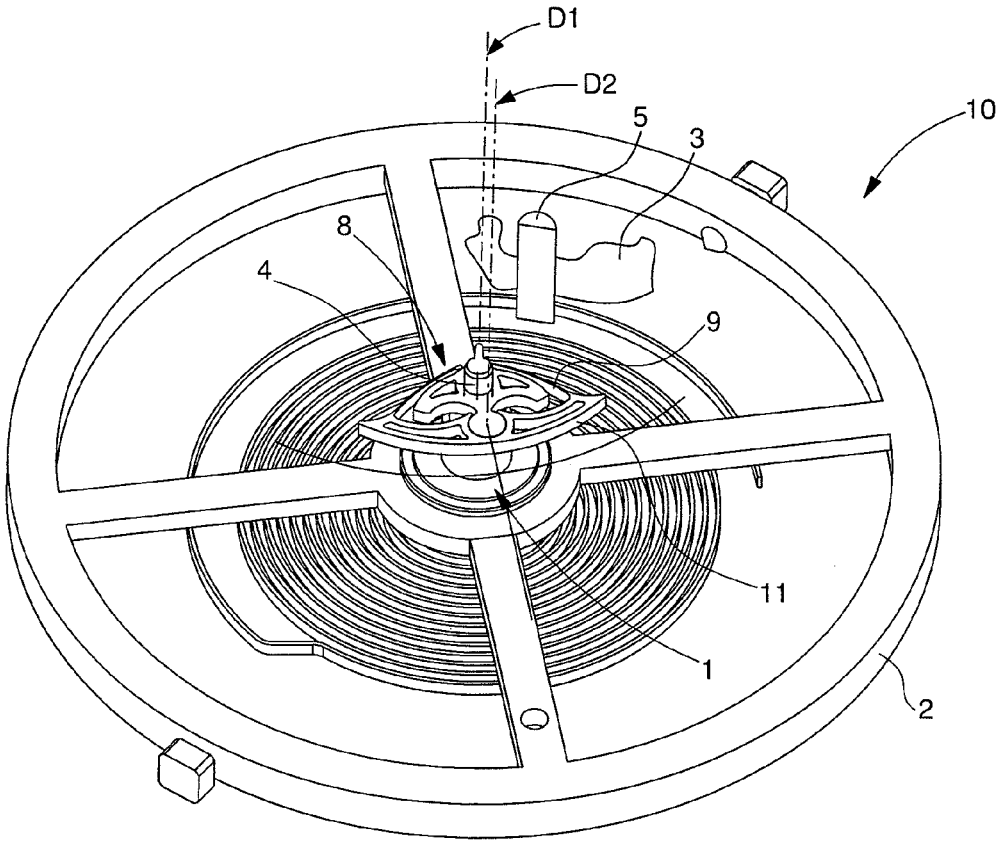
FIG. 1 shows a schematic perspective view of an escape mechanism according to the invention with an anti-trip device according to the invention, associated with a balance, associated with a balance spring and a plate which is not shown.
Figure 2:
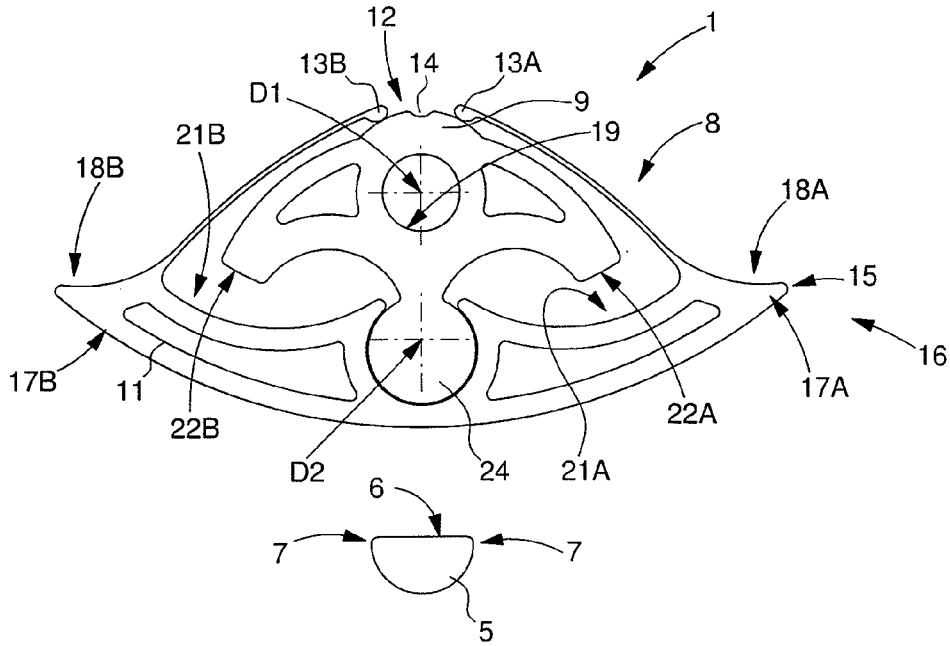
FIG. 2 shows a schematic front view of the anti-trip device of FIG. 1, in an assembly position.

The invention concerns the field of horology.

The invention concerns an anti-trip device 1 for an escape mechanism 10. This anti-trip mechanism 1 is arranged to cooperate with a balance 2, which pivots about a first pivot axis D1, whose position is fixed relative to a plate 3.

Anti-trip device 1 according to the invention is very simple, since it is formed of a maximum of three components: a banking pin 5 fixed to the plate of the escape mechanism, or of the movement, or of the timepiece, a rotor 9 fixed to the balance 2 and a bistable lever 11. It will be seen hereinafter that, in a particular version, it may be reduced to two components.

Thus, according to the invention, device 1 includes a banking pin 5 arranged to be fixed to plate 3, and at least one moveable bistable assembly 8.

This bistable assembly 8 includes, on the one hand, at least one rotor 9 arranged to be fixed to balance 2 and to pivot synchronously therewith, and on the other hand, a bistable lever 11, which is pivotally moveable relative to rotor 9 about a second pivot axis D2, parallel to the first pivot axis D1. This relative mobility occurs over a limited angular sector, of opening a, between two extreme indexing positions that can be occupied by indexing means 12 comprised in bistable assembly 8 for memorising the position and state of balance 2.

The integration of this bistable assembly 8 in balance 2 enables the position of the balance to be memorised, and thus to limit any excess amplitudes in the event of a shock, which represents considerable progress compared to the prior art. Bistable lever 11 pivots with limited travel on a centre of rotation that is off-centre relative to the centre of rotation of the balance.

At least one part of the trajectory of bistable lever 11 interferes with that of banking pin 5 when balance 2 is pivoting. Bistable assembly 8 further includes amplitude limiting means 15 for limiting the amplitude of angular pivoting of balance 2 in the event of a shock.

Figure 3:
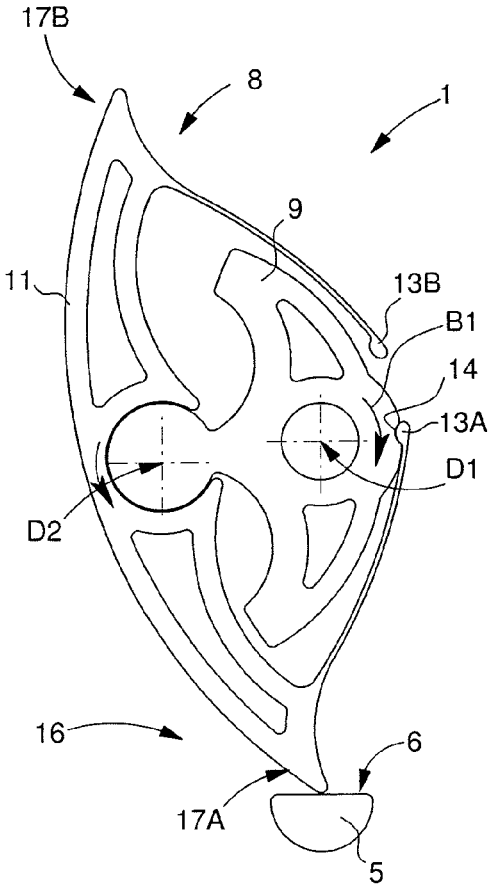
FIG. 3 shows a schematic front view of the anti-trip device of FIG. 1, in a clockwise state activation position.
Figure 4:
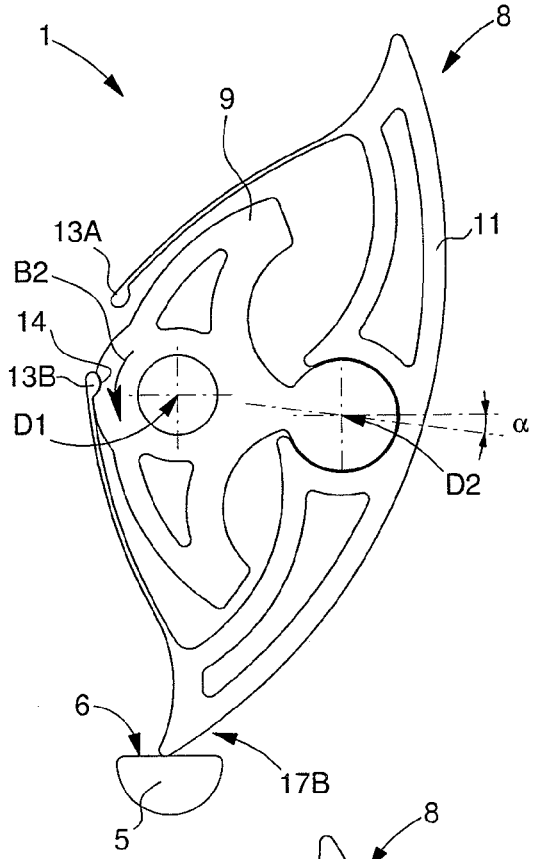
FIG. 4 shows a schematic front view of the anti-trip device of FIG. 1 in an anti-clockwise state activation position.

As seen in FIGS. 3 and 4, bistable assembly 8 may occupy two stable states: a so-called clockwise state, the activation of which is shown in FIG. 3, and a so-called anti-clockwise state, the activation of which is illustrated in FIG. 4. In normal operation, only these two states are used, except during transition from one state to another. This transition occurs when one of the ends of lever 11 encounters banking pin 5, thus tipping lever 11 into the opposite state to that which it occupied previously. Bistable assembly 8 changes state twice per complete oscillation of the balance.

This amplitude limiting means 15 includes at least first stop means 16 between bistable lever 11 and banking pin 5, which is arranged to form, on the one hand, when the amplitude of pivoting of the balance is normal, a pivot stop which, when said bistable assembly 8 abuts thereon, generates a change of position in indexing means 12 and, on the other hand, a stop member for balance 2, if knocking occurs in the event of a shock to balance 2, or to an assembly including balance 2.

The first stop means 16 includes at least a first shake stop surface 17, which is comprised in bistable lever 11 and arranged to cooperate with a first frontal surface 6 of banking pin 5 which points towards first pivot axis D1. The first stop means 16 also includes at least a second knocking stop surface 18 which is comprised in bistable lever 11 and arranged to cooperate with a second lateral surface 7 of banking pin 5. This second surface 7 points in a substantially orthogonal direction to that which joins banking pin 5 to the first pivot axis D1. The balance is stopped in this stop position, if balance 2 tends to race in the event of shock.

Preferably and advantageously, the amplitude limiting means 15 includes at least second stop means 20 between bistable lever 11 and rotor 9, which provides additional security in the event of a shock.

In a preferred embodiment, as seen in the Figures, the second stop means 20 includes at least a third stop surface 21, which is comprised in bistable lever 11 and arranged to cooperate in a stop position with at least one rotor stop surface 22 of rotor 9.

Return means, such as strip springs, which are preferably symmetrical and integral with bistable assembly 8, secured either to lever 11 as seen in the Figures, or to rotor 9 in another embodiment not shown in the Figures, permit the state of the balance to be maintained by clipping until the next semi-oscillation. It should be noted that any change of state in bistable lever 8, which is not caused by the action of banking pin 5, causes the escape mechanism to stop immediately, for example if one of the strip springs breaks.

Preferably, on bistable lever 11, indexing means 12 includes, for the extreme indexing positions, and preferably for each indexing position, a lever arm 13, or respectively a lever notch, arranged to cooperate with a rotor notch 14, or respectively a rotor arm, comprised in rotor 9. Intermediate indexing positions may be useful for mobilising the resistant torque, which is detrimental to the efficiency of the escapement, only in a gradual manner. However, the preferred embodiment is that shown in the Figures, with only two extreme indexing positions, each relating to a very precise state of balance 2.

In the preferred embodiment illustrated in the Figures, bistable lever 11 includes at least a first lever arm 13A and a second lever arm 13B corresponding to the indexing positions between which bistable lever 11 can pivot. Each arm is returned by elastic return means to the second pivot axis D2, and is arranged to cooperate in turn with rotor notch 14, arranged at the periphery of rotor 9. Preferably, rotor 9 is symmetrical relative to an axis passing through the two pivot axis D1 and D2, and bistable lever 11 is also symmetrical relative to a plane passing through pivot axis D2. This symmetry facilitates the dynamic balancing of bistable assembly 8.

Preferably, as seen in the Figures, arms 13A and 13B are strip springs, which each comprise an end arranged to cooperate with rotor notch 14. The arms are dimensioned such that the active length thereof is sufficient so as to use the least possible energy during the change of state, and so as to ensure that the lever is held in position in the event of any shock.

Thus, in this preferred version, bistable lever 11 includes a first so-called right shake stop surface 17A on the side of the first lever arm 13A, and a first so-called left shake stop surface 17B on the side of the second lever arm 13B. Each surface is arranged to cooperate, when balance 2 is pivoting, with the first frontal surface 6 of banking pin 5 so as to butt bistable lever 11 thereon while allowing balance 2 to continue its travel to change indexing position. While balance 2 continues its travel, in succession, it unhooks the lever arm which was engaged in rotor notch 14, and continues to pivot over a limited angular sector of amplitude a so as to hook the other lever arm in rotor notch 14.

Figure 5:
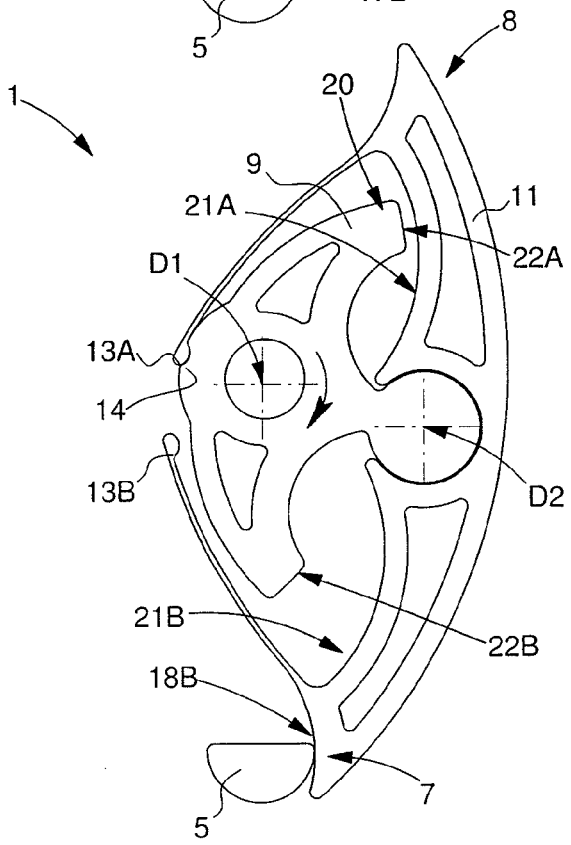
FIG. 5 shows a schematic front view of the anti-trip device of FIG. 1 in a knocking position in a clockwise state.

In the event of a shock, the other side of one of the ends of lever 11 rebounds onto banking pin 5: the balance is stopped and cannot continue to pivot, as seen in FIGS. 5 and 6.

Thus bistable lever 11 includes a second right knocking stop surface 18A on the side of the first lever arm 13A and a second left knocking stop surface 18B on the side of the second lever arm 13B, each of which is arranged to cooperate, when balance 2 is pivoting, with a second lateral surface 7 of banking pin 5, to butt bistable lever 11 thereon while allowing balance 2 to continue its travel to change indexing position.

When balance 2 continues its travel, in succession, it unhooks the lever arm which was engaged in rotor notch 14 and continues to pivot over a limited angular sector so as to hook the other lever arm in rotor notch 14. Then, only in the event that the energy from the shock transmitted to balance 2 tends to cause said balance to pivot beyond this extreme indexing position, as it pivots, balance 2 brings a stop surface 22 of said rotor 9 to but on a third limit stop surface 21 of bistable lever 11 into a final stopped position in this stop position. Subsequently, the return torque of the balance spring is sufficient to release balance 2 and the movement can return to normal operation without any disruption.

These rotor stop members 22 are only used in the event of a shock and are not used in normal operation.

In an alternative embodiment not shown in the Figures, bistable assembly 8 includes elastic dampening means on the second knocking stop surface 18A, 18B, and/or the third stop surface 21A, 21B, and/or a rotor stop surface 22A, 22B, to provide additional security when the energy transmitted by a shock to balance 2 tends to make the latter pivot beyond an extreme indexing position.

It is naturally possible to provide anti-trip device 1 according to the invention with means for axially holding bistable assembly 8 or at least lever 11. For the sake of simplification, this means is not shown in the Figures.

Bistable assembly 8 is preferably dynamically balanced about first pivot axis D1 of balance 2 according to the maximum angular velocity of pivoting of balance 2 about first pivot axis D1.

In an advantageous and preferred embodiment, as seen in FIG. 7, bistable assembly 8 is made in a single-piece, and the connection between rotor 9 and bistable lever 11 is achieved by a connecting surface 24, preferably formed by elastic return means, arranged to cause bistable lever 11 to pivot about a virtual pivot of axis D2.

In an embodiment that is still further integrated, bistable assembly 8 is made in a single-piece with a balance 2, or bistable assembly 8 is even made in a single-piece with balance 2, which is in turn made in a single-piece with a balance spring.

Very advantageously, rotor 9 and/or bistable lever 11 is made in a micro-machinable material, or silicon, or quartz or a compound thereof, or an alloy derived from MEMS technology, or an alloy such as that obtained by the DRIE or LIGA methods, or in an at least partially amorphous material.

The invention also concerns an escape mechanism 10 including at least one balance 2, which is pivotally moveable relative to a plate 3 and pivots about a balance axis D1. Advantageously, it is a detent escape mechanism and includes an anti-trip device 1 according to the invention, wherein the banking banking pin 5 is fixed to plate 3, the rotor 9 is fixed, particularly by shrinking or suchlike, in a bore 19 of said rotor, to an arbour 4 of balance 2 and wherein bistable lever 11 is pivotally mounted about a second pivot axis D2 parallel to first pivot axis D1.

In an advantageous embodiment of this escape mechanism 10, the formed of balance 2 and lever 11 is preferably in a single-piece and made of micro-machinable material, or silicon, or quartz or a compound thereof, or an alloy derived from MEMS technology, or an alloy obtained via the DRIE or LIGA methods, or made of an at least partially amorphous material. This unit may also be made in a single-piece with a balance spring, as disclosed in EP Patent No. 2,104,008 in the name of the Applicant.

The invention also concerns a timepiece movement including at least one escape mechanism of this type, or at least one anti-trip device 1 of this type.

The invention further concerns a timepiece including at least one timepiece movement of this type and/or at least one escape mechanism of this type or at least one anti-trip device 1 of this type.

The invention thus offers a reliable solution, which is easy to implement and has the advantage of being applicable to any existing detent escapement model at the cost of minor alterations, consisting in securing a rotor to the balance axis and securing a banking pin to the plate. This anti-trip device is elegant, easily integrated, has few components and is, above all, very reliable and allows the escape mechanism to return to normal operation after a shock.

What is claimed is:

1. An anti-trip device for an escape mechanism, arranged to cooperate with a balance, which pivots about a first pivot axis, whose position is fixed relative to a plate, wherein said device includes a banking pin arranged to be fixed to said plate, and at least one moveable bistable assembly which includes, on the one hand, at least one rotor arranged to be fixed to said balance and to pivot synchronously therewith, and on the other hand, a moveable bistable lever that pivots relative to said rotor about a second pivot axis, parallel to said first pivot axis, over a limited angular sector between two indexing positions that can be occupied by indexing means comprised in said bistable assembly for memorising the position of said balance, wherein at least one part of the trajectory of said bistable lever interferes with said banking pin when said balance pivots, and said bistable assembly further includes amplitude limiting means for limiting the amplitude of angular pivoting of said balance in the event of a shock.

2. The anti-trip device according to claim 1, wherein said amplitude limiting means includes at least first stop means between said bistable lever and said banking pin, arranged to form, on the one hand a pivot stop, when the amplitude of pivoting of the balance is normal and which, when said bistable assembly abuts thereon, generates a change of position in said indexing means, and on the other hand, a stop member for said balance if any knocking occurs in the event of a shock to said balance or to an assembly including said balance.

3. The anti-trip device according to claim 2, wherein said first stop means includes at least a first shake stop surface which is comprised in said bistable lever and arranged to cooperate with a first frontal surface of said banking pin and which points towards said first pivot axis, and said means further includes at least a second knocking stop surface which is comprised in said bistable lever and arranged to cooperate with a second lateral surface of said banking pin and which points in a substantially orthogonal direction to that joining said pin to said first pivot axis.

4. The anti-trip device according to claim 1, wherein said amplitude limiting means includes at least second stop means between said bistable lever and said rotor.

5. The anti-trip device according to claim 4, wherein said second stop means includes at least a third stop surface, which is comprised in said bistable lever and arranged to cooperate in a stop position with at least one rotor stop surface of said rotor to form a second security device when the energy transmitted by a shock tends to cause said balance to pivot beyond an extreme indexing position.

6. The anti-trip device according to claim 1, wherein, on said bistable lever, said indexing means includes, for each said indexing position, a lever arm, or respectively a lever notch, arranged to cooperate respectively with a rotor notch or respectively a rotor arm of said rotor.

7. The anti-trip device according to claim 6, wherein said bistable lever includes at least a first lever arm and a second lever arm corresponding to the indexing positions between which said bistable lever can pivot, each returned by elastic return means towards said second pivot axis, and each arranged to cooperate in turn with said rotor notch, arranged at the periphery of said rotor.

8. The anti-trip device according to claim 3, wherein said bistable lever includes a first right shake stop surface on the side of said first lever arm, and a first left shake stop surface on the side of said second lever arm, each of which is arranged to cooperate, when said balance is pivoting, with said first frontal surface of said banking pin to butt bistable lever thereon while allowing the travel of said balance to continue so as to change indexing position.

9. The anti-trip device according to claim 5, wherein said bistable lever includes a second right knocking stop surface on the side of said first lever arm and a second left knocking stop surface on the side of said second lever arm, each of which is arranged to cooperate, when said balance is pivoting, with one said second lateral surface of said pin, to butt said bistable lever thereon while allowing the travel of said balance to continue so as to change indexing position.

10. The anti-trip device according to claim 3, wherein it includes elastic dampening means on said second knocking stop surface, and/or on said third stop surface, and/or a rotor stop surface.

11. The anti-trip device, according to claim 1, wherein said rotor is symmetrical relative to an axis passing through said first and second pivot axis and wherein said bistable lever is symmetrical relative to a plane passing through said second pivot axis.

12. The anti-trip device according to claim 1, wherein said bistable assembly is made in a single-piece and in that the connection between said rotor and said bistable lever is achieved by elastic return means.

13. The anti-trip device according to claim 12, wherein said bistable assembly is made in a single-piece with a balance.

14. The anti-trip device according to claim 13, wherein said bistable assembly is made in a single-piece with said balance, which is in turn made in a single-piece with a balance spring.

15. The anti-trip device according to claim 1, wherein said rotor and/or said bistable lever is made of silicon, or quartz, or a compound thereof, or of an at least partially amorphous material.

16. An escape mechanism including at least one balance, pivotally moveable relative to said plate and pivoting about a balance axis, wherein the mechanism is a detent escape mechanism, and in that it includes an anti-trip device according to claim 1, wherein said banking pin is fixed to said plate, wherein said rotor is fixed to an arbour of said balance and wherein said bistable lever is pivotally mounted about said second pivot axis parallel to said first pivot axis.

17. A timepiece movement incorporating at least one escape mechanism according to claim 16.

18. A timepiece including at least one timepiece movement with at least one escape mechanism according to claim 16.

19. A timepiece movement incorporating at least one anti trip device according to claim 1.

20. A timepiece including at least one timepiece movement with at least one anti trip device according to claim 1.

* * * * *